United States Patent [19]

Kimura et al.

[11] Patent Number: 4,837,108

[45] Date of Patent: Jun. 6, 1989

[54] AUSTENITIC FREE CUTTING STAINLESS STEELS

[75] Inventors: Atsuyoshi Kimura, Kuwana; Noriyoshi Shibata, Nagoya, both of Japan

[73] Assignee: Daido Tokushuko Kabushiki Kaisha, Japan

[21] Appl. No.: 205,518

[22] Filed: Jun. 13, 1988

Related U.S. Application Data

[63] Continuation-in-part of Ser. No. 890,237, Jul. 29, 1986, abandoned.

[30] Foreign Application Priority Data

Jul. 31, 1985 [JP] Japan ..... 60-170152

[51] Int. Cl.[4] ..... C22C 38/60

[52] U.S. Cl. ..... 420/41; 420/42; 420/584

[58] Field of Search ..... 420/41, 42, 82, 584

[56] References Cited

FOREIGN PATENT DOCUMENTS 55-110757 8/1980 Japan ..... 420/41

57-63668 4/1982 Japan ..... 420/41

*Primary Examiner*—Deborah Yee

*Attorney, Agent, or Firm*—Sughrue, Mion, Zinn, Macpeak, and Seas

[57] ABSTRACT

An austenitic stainless steel having improved free cutting properties is disclosed, which consists essentially of, on a weight ratio, C≦0.2%. Si≦2.0%, Mn≦2.0%, 7.5%≦Cr≦30.0%, Ni≦40.0%, 0.005%≦Bi≦0.50%, 0.0003%≦B≦0.10%, 0.002%≦S≦0.40%, P≦0.02%, N≦0.05% and/or O≦0.005% and the balance being Fe.

8 Claims, 1 Drawing Sheet

AUSTENITIC FREE CUTTING STAINLESS STEELS

This is a continuation-in-part of application Ser. No. 890,237 filed July 29, 1986, now abandoned

BACKGROUND OF THE INVENTION

1. Field of the Invention

This invention relates to a free cutting stainless steel, and more particularly to an austenitic free cutting stainless steel containing Bi as a necessary free cutting element for the provision of free cutting properties.

2. Related Art Statement

In general, stainless steels are large in the viscosity, poor in the heat conductivity, and are apt to be coherent to a tool in the cutting, so that they are difficult to be subjected to the cutting work. Therefore, it has been studied and developed to improve the free cutting properties of the stainless steel by the addition of a free cutting element such as S, Pb, Bi, Te, Se or the like, and the resulting steels have been applied to various uses as a free cutting stainless steel.

In the free cutting stainless steel of this type, however, the free cutting properties are improved by the addition of the free cutting element, but the hot workability is inversely degraded due to the addition of such a free cutting element, which comes into problem in the production. In the austenitic stainless steel, the hot workability is not so good, and is considerably degraded by adding the free cutting element.

Furthermore, the stainless steel is utilized in wide applications owing to the corrosion resistance. Particularly, the austenitic stainless steel has an excellent corrosion resistance, so that it is suitable for various application. However, the application of such steels may be restricted due to the presence of the free cutting element. For example, the addition of S, Pb, Te, Se and the like comes into problem in the corrosion resistance and food hygiene when the steel is used as a material for food machines, and particularly the addition of Pb can not be adopted due to the latter problem. On the other hand, since Bi is an element used in chemicals, cosmetics and the like, it has been considered that Bi is optimum to be applied to free cutting stainless steels for use in the food machine, but the addition of Bi considerably degrades the hot workability, which comes into problem in view of the production.

SUMMARY OF THE INVENTION

It is, therefore, an object of the invention to solve the aforementioned problems of the prior art and to provide a novel Bi-containing austenitic free cutting stainless steel which can expect the enlarging of application without degrading the hot workability even when Bi is added as a free cutting element to austenitic stainless steel having an excellent corrosion resistance.

The inventors have made various studies in order to prevent the degradation of the hot workability even when Bi is added as an essential free cutting element to an austenitic stainless steel, and found that the degradation of the hot workability can considerably be prevented by adding a relatively large amount of B which has hitherto been used in a very slight amount as a quench-improving element. Based on this knowledge, various experiments for more improving the properties of Bi-containing austenitic free cutting stainless steel have been made, from which the invention has been accomplished.

According to this invention, there is the provision of a Bi-containing austenitic free cutting stainless steel consisting essentially of not more than 0.2 wt. % of C, not more than 2.0 wt. % of Si, not more than 2.0 wt. % of Mn, 7.5–30.0 wt. % of Cr, not more than 40.0 wt. % of Ni, 0.005–0.50 wt. % of Bi, 0.0003–0.10 wt. % of B, 0.002–0.40 wt. % of S, not more than 0.20 wt. % of P, not more than 0.05 wt. % of N and not more than 0.005 wt. % of O, and the balance being Fe and inevitable impurities.

In the preferred embodiment of the invention, the steel further contains one or more of the following groups:

(1) at least one of not more than 5.0 wt. % of Mo, not more than 4.0 wt. % of Cu and not more than 1.50 wt. % of Al;

(2) at least one of not more than 0.5 wt. % of Zr, not more than 2.0 wt. % of Ti, not more than 3.0 wt. % of Nb, not more than 0.5 wt. % of V and not more than 0.5 wt. % of Ta; and (3) at least one of not more than 0.009 wt. % of Ca and not more than 0.35 wt. % of Se.

DESCRIPTION OF THE PREFERRED EMBODIMENTS

Figure 1:
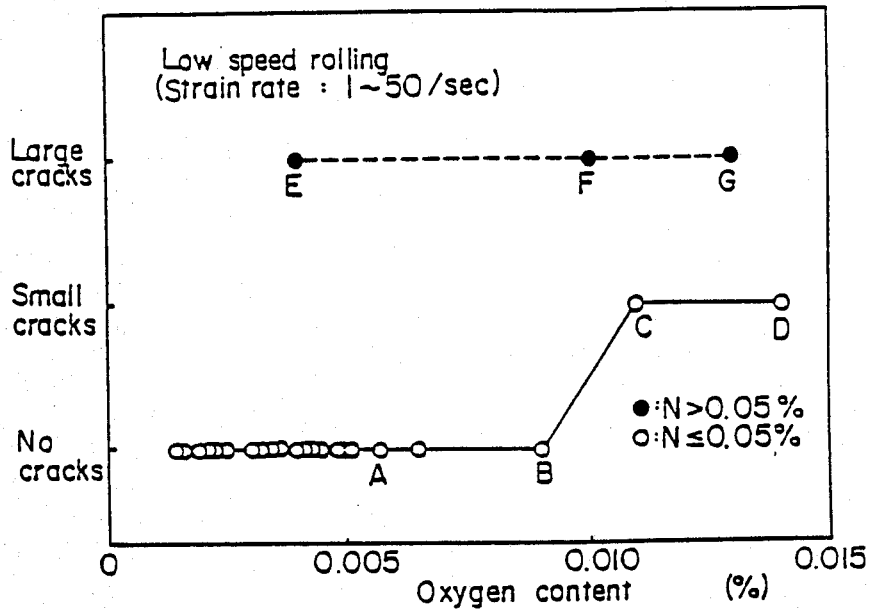
FIGS. 1 and 2 are graphs of experimental results showing the influence of O and N contents on hot workability.

The reason why the chemical composition of the steel according to the invention is limited to the above range will be described below.

The invention fundamentally aims at the improvement of the free cutting properties by the addition of Bi as a necessary free cutting element and the prevention of the degradation of the hot workability based on the addition of Bi by adding B, Of course, the addition of B can be performed for the improvement of the free cutting properties and is effective for preventing the degradation of the hot workability against the addition of the other elements causing the degradation of the hot workability.

Bi is an element considerably effective for improving the free cutting properties as described above and causing no problem in view of food hygiene, so that it is necessary to add at least 0.005% of Bi. However, if the amount is too large, the hot workability is considerably degraded and can not sufficiently be ensured even in the addition of B, so that the upper limit is 0.50%.

B is an element effective for preventing the degradation of the hot workability due to the addition of Bi as well as the addition of the other free cutting element. Furthermore, B reacts with N, O properly contained in steel as mentioned later to form nitride (BN), oxide ($B_2O_3$), whereby the free cutting properties can be improved without causing the degradation of the hot workability. Moreover, B can improve the yield of Bi in the addition of Bi. In order to ensure these effects, it is necessary to add at least 0.0003% of B. However, if the amount is too large, the above effect can not be expected, so that the upper limit should be 0.10% in view of the cost and addition yield.

C is a strong austenite-forming element. It is desirable that the amount of C is less in view of the corrosion resistance. Particularly, in case of the austenitic stainless steel aiming at the invention, the amount of C is not more than 0.2%.

Si is an element acting as a deoxidizer and is effective for increasing the oxidation resistance, but is a ferrite-forming element. If the amount of Si is too large, the toughness is decreased, so that the upper limit is 2.0%.

Mn forms a compound with S, Se or the like to effectively prevent the hot brittleness and is used as an effective deoxydizer. However, if the amount is too large, not only the free cutting properties are degraded, that the upper limit is 10.0%.

Cr is a fundamental element for austenitic stainless steel. It is necessary to add 7.5–30.0% of Cr in order to improve the corrosion resistance and oxidation resistance of such a steel.

Ni is a preferable and important element in the austenitic stainless steel and forms a stable austenitic phase to effectively improve the corrosion resistance and toughness. However, if the amount is too large, the free cutting properties are degraded, and the cost becomes higher, so that the upper limit is 40.0%.

S is an element for giving the free cutting properties to the austenitic stainless steel. If the amount is too large, the hot workability and corrosion resistance are degraded, so that the upper limit is 0.40%. Particularly, if it is intended to require high corrosion resistance as in the food machine, the amount is favorable to be not more than 0.02%. However, if the amount is less than 0.002%, the increase of the cost is caused in the production and the free cutting properties are degraded, so that the lower limit is 0.002%.

P is an element for providing the free cutting properties. If the amount is too large, the hot workability is degraded, so that the upper limit is 0.20%.

N is effective not only for improving the free cutting properties by bonding with B to form nitride, but also for increasing the tensile strength and stabilizing austenite. If the amount is too large, the effect of improving the hot workability based on the addition of B is obstructed, so that the upper limit is 0.10%. Especially, the austenitic stainless steel is not so good in the hot workability, so that it is preferable that the amount of N is not more than 0.05% in order to ensure the sufficient hot workability based on the addition of B.

O forms an oxide with B, which is effective for improving the free cutting properties, but is harmful for the corrosion resistance and hot workability.

The lower limit for improving the free cutting properties is 0.002%. However if the amount is too large, the hot workability is degraded, so that the upper limit is 0.4%. In Bi-containing steel, the amount of not more than 0.005% considerably improves the hot workability, which is preferable in case of requiring high hot workability as in high speed rolling or the like.

In the steels having the above fundamental chemical composition according to the invention, at least one of Mo, Cu and Al may be added as an element for improving the corrosion resistance and oxidation resistance, if necessary.

Mo has an effect of improving the corrosion resistance by forming a passive film in Cr-Ni series stainless steel, but if the amount is too large, the effect is inversely lost, so that the upper limit is 5.0%.

Cu is an austenite-forming element and improves the corrosion resistance. If the amount is too large, the hot workability is degraded, so that the upper limit is 4.0%.

Al is an element for improving the oxidation resistance. When Al is used for deoxidation, it may be added so as to retain 0.005–0.050% of Al in steel. In the precipitation hardening type steel, Al may be added in an amount of not more than 1.5%.

If necessary, at least one of Zr, Ti, Nb, V and Ta may be added to the steel of the above basic composition. These elements can improve the corrosion resistance, strength and the like at proper amounts and are effective for improving the hot workability. Considering the free cutting properties, cost and the like, Zr of not more than 0.5%, Ti of not more than 2.0%, Nb of not more than 3.0%, V of not more than 0.5% and Ta of not more than 0.5% may be added, respectively.

Furthermore, at least one of Ca and Se may be added to the steel of the basic composition, if necessary, in order to more improve the free cutting properties. Considering the cleanliness, corrosion resistance, hot workability and the like, Ca of not more than 0.009% and/or Se of not more than 0.35% may be added. However, it is preferable to perform no addition of Se if it is intended to use the steel according to the invention as a material for the food machine.

The following example is given in illustration of the invention and is not intended as limitation thereof.

EXAMPLE

Each of austenitic stainless steels having a chemical composition as shown in the following Table 1 was melted in an arc furnace of 2 ton capacity, refined in a ladle refining apparatus (GRAF), and then cast into an ingot of 2 tons.

Then, the ingot was heated at about 1250°C., which was rolled into a billet of 140 mm square to examine the hot workability. In this case, the hot workability was evaluated by an appearance test for examining the presence of billet cracking and by a hot tensile test (1250° C.) of a speciment cut out from the surface portion of the billet to measure fracture draw (%). These measured results are shown in the following Table 4.

In order to examine the free cutting properties, the ingot was forged into a rod of 60 mm in diameter, which was subjected to a drill cutting test against soluted materials under conditions shown in the following Table 2. The free cutting properties were evaluated as a drilling property (cutting rate till the tool life reached 1000 mm) (m/min). The results are also shown in Table 4.

The corrosion resistance was evaluated by weight loss after the same material as used in the above cutting test was immersed in a solution shown in the following Table 3. The results are shown in Table 4.

TABLE 1

| Steel | Chemical composition (wt %) | | | | | | | | | | | | | |
|---|---|---|---|---|---|---|---|---|---|---|---|---|---|---|
| No. | C | Si | Mn | P | S | Cr | Bi | B | N | O | Ni | Mo | Cu | others |
| 1 | 0.03 | 0.43 | 0.80 | 0.016 | 0.016 | 19.10 | 0.02 | 0.0006 | 0.030 | 0.0040 | 8.30 | — | — | — |
| 2 | 0.04 | 0.61 | 0.75 | 0.020 | 0.021 | 19.20 | 0.03 | 0.0018 | 0.028 | 0.0035 | 9.40 | — | — | — |
| 3 | 0.03 | 0.45 | 0.80 | 0.017 | 0.015 | 19.12 | 0.01 | 0.0051 | 0.032 | 0.0050 | 8.25 | — | — | — |
| 4 | 0.04 | 0.60 | 0.76 | 0.022 | 0.020 | 19.24 | 0.06 | 0.0062 | 0.028 | 0.0043 | 9.42 | — | — | — |
| 5 | 0.08 | 0.50 | 0.92 | 0.024 | 0.005 | 19.32 | 0.15 | 0.0066 | 0.035 | 0.0025 | 8.05 | — | — | — |
| 6 | 0.07 | 0.52 | 0.86 | 0.016 | 0.012 | 19.27 | 0.06 | 0.0030 | 0.042 | 0.0050 | 8.25 | — | — | V: 0.03 |
| 7 | 0.01 | 0.42 | 0.87 | 0.018 | 0.017 | 18.48 | 0.10 | 0.0070 | 0.050 | 0.0020 | 9.52 | — | — | Ta: 0.03 |

TABLE 1-continued

| Steel No. | Chemical composition (wt %) C | Si | Mn | P | S | Cr | Bi | B | N | O | Ni | Mo | Cu | others |
|---|---|---|---|---|---|---|---|---|---|---|---|---|---|---|
| | | | | | | | | | | | | | | Al: 0.05 |
| 8 | 0.02 | 0.70 | 0.94 | 0.020 | 0.016 | 17.42 | 0.10 | 0.0065 | 0.048 | 0.0032 | 10.77 | 1.95 | — | — |
| 9 | 0.03 | 0.28 | 0.86 | 0.020 | 0.016 | 18.43 | 0.11 | 0.0040 | 0.042 | 0.0035 | 11.62 | 1.99 | 2.00 | — |
| 10 | 0.04 | 0.35 | 1.46 | 0.022 | 0.051 | 18.52 | 0.15 | 0.0052 | 0.044 | 0.0015 | 10.33 | — | — | Zr: 0.052 |
| 11 | 0.05 | 0.40 | 0.78 | 0.052 | 0.016 | 19.00 | 0.10 | 0.0055 | 0.040 | 0.0022 | 9.18 | — | — | Ti: 0.02 |
| 12 | 0.05 | 0.43 | 0.82 | 0.016 | 0.020 | 18.43 | 0.25 | 0.0080 | 0.021 | 0.0043 | 10.43 | — | — | Nb: 0.03<br>Ca: 0.0031<br>Se: 0.051 |
| 13 | 0.03 | 0.38 | 1.85 | 0.018 | 0.015 | 19.07 | 0.03 | 0.0023 | 0.028 | 0.0043 | 8.35 | — | — | — |
| 14 | 0.05 | 0.62 | 0.80 | 0.020 | 0.018 | 19.20 | 0.05 | 0.070 | 0.025 | 0.0045 | 9.00 | — | — | — |
| 15 | 0.16 | 0.52 | 0.90 | 0.026 | 0.004 | 25.00 | 0.20 | 0.090 | 0.033 | 0.0022 | 20.00 | — | — | — |
| 16 | 0.03 | 0.75 | 0.95 | 0.021 | 0.020 | 17.00 | 0.11 | 0.050 | 0.045 | 0.0031 | 30.00 | 1.90 | — | — |
| 17 | 0.04 | 0.28 | 0.83 | 0.022 | 0.016 | 19.05 | 0.10 | 0.045 | 0.040 | 0.0036 | 15.60 | 2.05 | 2.10 | — |
| 18 | 0.04 | 0.30 | 1.45 | 0.020 | 0.050 | 24.50 | 0.30 | 0.025 | 0.045 | 0.0016 | 10.30 | — | — | Zr: 0.050 |
| 19 | 0.06 | 0.42 | 0.85 | 0.015 | 0.021 | 26.40 | 0.25 | 0.050 | 0.022 | 0.0042 | 20.40 | — | — | Ca: 0.0030<br>Se: 0.050 |
| 20 | 0.03 | 0.42 | 0.88 | 0.020 | 0.020 | 18.33 | — | — | 0.062 | 0.0125 | 8.52 | — | — | — |
| 21 | 0.05 | 0.45 | 0.75 | 0.025 | 0.032 | 19.05 | 0.05 | — | 0.060 | 0.0140 | 8.04 | — | — | — |
| 22 | 0.08 | 0.66 | 0.77 | 0.018 | 0.016 | 18.94 | 0.10 | 0.0002 | 0.052 | 0.0080 | 8.34 | — | — | — |
| 23 | 0.09 | 0.45 | 1.28 | 0.022 | 0.285 | 18.14 | — | — | 0.055 | 0.0145 | 9.15 | — | — | — |

TABLE 2

| Cutting Conditions | |
|---|---|
| Tool | drill (SKH 9), diameter 5 mm |
| Feed rate | 0.15 mm/rev |
| Depth of hole | 20 mm |
| Cutting oil | none |
| Criterion of tool life | tool failure |

TABLE 3

| Test conditions and evaluation standard for corrosion resistance (weight loss after continuous immersion in a boiling solution for 6 hours) | | 20% acetic acid | 5% sulfuric acid | 15% nitric acid |
|---|---|---|---|---|
| Evaluation | A | 0~10 (g/m$^2$ · hr) | 0~100 (g/m$^2$ · hr) | 0~1.0 (g/m$^2$ · hr) |
| | B | 10~100 (g/m$^2$ · hr) | 100~500 (g/m$^2$ · hr) | 1.0~5.0 (g/m$^2$ · hr) |
| | C | 100~500 (g/m$^2$ · hr) | 500~1000 (g/m$^2$ · hr) | 5.0~100 (g/m$^2$ · hr) |

TABLE 4

| Steel No. | Hot workability: Billet cracking | Hot workability: Hot fracture draw (%) | Free cutting property (drilling property) (m/min) | Corrosion resistance: 20% acetic acid | Corrosion resistance: 5% sulfuric acid | Corrosion resistance: 15% nitric acid |
|---|---|---|---|---|---|---|
| 1 | none | 80 | 15 | A | A | A |
| 2 | none | 84 | 20 | A | A | A |
| 3 | none | 81 | 15 | A | A | A |
| 4 | none | 92 | 20 | A | A | A |
| 5 | none | 90 | 22 | A | A | A |
| 6 | none | 93 | 20 | A | A | A |
| 7 | none | 92 | 21 | A | A | A |
| 8 | none | 93 | 22 | A | A | A |
| 9 | none | 92 | 22 | A | A | A |
| 10 | none | 90 | 28 | A | A | A |
| 11 | none | 92 | 21 | A | A | A |
| 12 | none | 92 | 28 | A | A | A |
| 13 | none | 93 | 15 | A | A | A |
| 14 | none | 92 | 17 | A | A | A |
| 15 | none | 90 | 22 | A | A | A |
| 16 | none | 93 | 22 | A | A | A |
| 17 | none | 92 | 22 | A | A | A |
| 18 | none | 90 | 28 | A | A | A |
| 19 | none | 92 | 22 | A | A | A |
| 20 | none | 92 | 10 | A | A | A |
| 21 | presence of large cracking | 57 | 18 | A | A | A |
| 22 | presence of large cracking | 45 | 21 | A | A | A |
| 23 | none | 85 | 25 | B | C | B |

As seen from the results of Table 4, the steel Nos. 1–19 according to the invention effectively prevent the degradation of the hot workability, so that they are able to be subjected to the usual hot rolling. Further, they are considerably excellent in the free cutting properties and corrosion resistance. On the other hand, the comparative steel Nos. 21 and 22 containing the defined amount of Bi but no B or very small amount of B are poor in the hot workability to produce large cracking in the hot rolling and small in the hot fracture draw.

EXPERIMENT

An effect of O and N was confirmed employing austenitic stainless steels having chemical compositions as shown in the following Table 5.

These steels in which the amount of O or N or both is designed in high comparatively, were melted, refined and then cast into an ingot of 2 tons in the same manner as Example in the present application.

TABLE 5

| Steel | Chemical composition (wt %) | | | | | | | | | | |
|---|---|---|---|---|---|---|---|---|---|---|---|
| No. | C | Si | Mn | P | S | Cr | Bi | B | N | O | Ni |
| A | 0.07 | 0.45 | 0.89 | 0.013 | 0.003 | 19.31 | 0.05 | 0.0050 | 0.030 | 0.0058 | 8.93 |
| B | 0.06 | 0.48 | 0.77 | 0.022 | 0.008 | 19.26 | 0.08 | 0.0062 | 0.034 | 0.0090 | 9.01 |
| C | 0.08 | 0.62 | 0.86 | 0.015 | 0.010 | 19.29 | 0.08 | 0.0039 | 0.029 | 0.0110 | 9.10 |
| D | 0.07 | 0.42 | 0.83 | 0.026 | 0.015 | 19.30 | 0.05 | 0.0050 | 0.038 | 0.0140 | 9.07 |
| E | 0.07 | 0.45 | 0.83 | 0.022 | 0.012 | 19.18 | 0.06 | 0.0051 | 0.066 | 0.0040 | 9.22 |
| F | 0.08 | 0.53 | 0.90 | 0.023 | 0.013 | 19.19 | 0.10 | 0.0070 | 0.074 | 0.0102 | 8.78 |
| G | 0.07 | 0.57 | 0.87 | 0.027 | 0.012 | 19.22 | 0.05 | 0.0065 | 0.070 | 0.0130 | 8.84 |

Then, the ingot was heated at about 1250° C., which was rolled with two kinds of rolling speed as mentioned hereunder to examine the hot workability.

First, the ingot was rolled into a billet in relatively low strain rate, and was rolled into a wire in high strain rate to examine the hot workability in higher degree. In these cases, the hot workability was evaluated with size of cracking by an appearance test.

Figure 2:
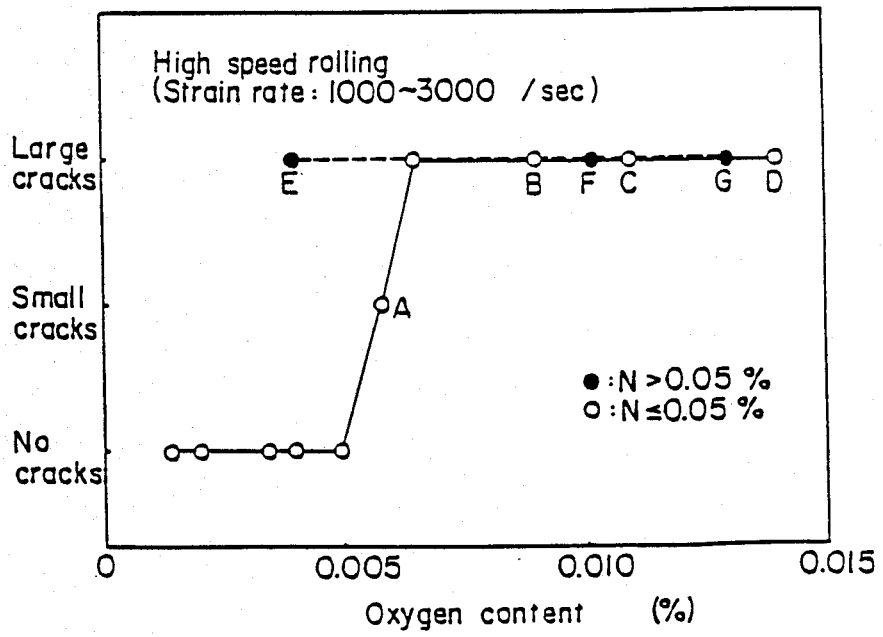

The results are shown in FIG. 1 and FIG. 2 in company with examined results concerning the steels at Table 1 in the present application. In these figures, the small cracks mean such slight cracks that are easy to be cut off with scarfing or grinding.

As can easily be seen from FIG. 1 and FIG. 2, the size of cracking gets larger as amount of O and N increase.

Particulary in high speed rolling, minimizing the amount of O to not more than 0.005% and the amount of N to not more than 0.05% is markedly effective to prevent the crack arising along with rolling, and enables the high speed rolling such that strain rate exceeds 1000/sec.

It can be considered that B does not act so effectively to improve the hot workability under existence of O or N, because B is comsumed by forming Oxide or Nitride.

Therefore it is obvious that minimizing amount of O and N simultaneously is necessary for improving the hot workability and performing the high speed rolling, and so increasing the productivity.

As mentioned above in detail, according to the invention, the degradation of the hot workability can be prevented by adding a proper amount of B to Bi-containing austenitic stainless steel exhibiting a conspicuous degradation of hot workability, and further the free cutting properties and corrosion resistance can be considerably improved by adjusting the amounts of the other elements without degrading the hot workability. Therefore, the invention does not come into problems in the production of the steels and food hygiene and is widely applicable to materials for food machines and the like.

What is claimed is:

1. A bismuth-containing austenitic free cutting stainless steel consisting essentially of not more than 0.2 wt. % of C, not more than 2.0 wt. % of Si, not more than 2.0 wt. % of Mn, 7.5–30.0 wt. % of Cr, not more than 40.0 wt. % of Ni, 0.005–0.50 wt. % of Bi, 0.0003–0.10 wt. % of B, 0.002–0.40 wt. % of S, not more than 0.20 wt. % of P not more than 0.05 wt. % of N and not more than 0.005 wt. % of O, and the balance being Fe and inevitable impurities.

2. The bismuth-containing austenitic free cutting stainless steel according to claim 1, wherein said steel further contains at least one of not more than 5.0 wt. % of Mo, not more than 4.0 wt. % of Cu and not more than 1.50 wt. % of Al.

3. The bismuth-containing austenitic free cutting stainless steel according to claim 1, wherein said steel further contains at least one of not more than 0.5 wt. % of Zr, not more than 2.0 wt. % of Ti, not more than 3.0 wt. % of Nb, not more than 0.5 wt. % of V and not more than 0.5 wt. % of Ta.

4. The bismuth-containing austenitic free cutting stainless steel according to claim 1, wherein said steel further contains at least one of not more than 0.009 wt. % of Ca and not more than 0.35 wt. % of Se.

5. The bismuth-containing austenitic free cutting stainless steel according to claim 1, wherein said steel further contains at least one of not more than 0.5 wt. % of Zr, not more than 2.0 wt. % of Ti, not more than 3.0 wt. % of Nb, not more than 0.5 wt. % of V and not more than 0.5 wt. % of Ta, and at least one of not more than 0.009 wt. % of Ca and not more than 0.35 wt. % of Se.

6. The bismuth-containing austenitic free cutting stainless steel according to claim 1, wherein said steel further contains at least one of not more than 5.0 wt. % of Mo, not more than 4.0 wt. % of Cu and not more than 1.50 wt. % of Al, and at least one of not more than 0.5 wt. % of Zr, not more than 2.0 wt. % of Ti, not more than 3.0 wt. % of Nb, not more than 0.5 wt. % of V and not more also the corrosion resistance is degraded, so that it is preferable that the amount of Mn is not more than 2.0% in order to obtain sufficient corrosion resistance.

7. The bismuth-containing austenitic free cutting stainless steel according to claim 1, wherein said steel further contains at least one of not more than 5.0 wt. % of Mo, not more than 4.0 wt. % of Cu and not more than 1.50 wt. % of Al, and at least one of not more than 0.009 wt. % of Ca and not more than 0.35 wt. % of Se.

8. The bismuth-containing austenitic free cutting stainless steel according to claim 1, wherein said steel further contains at least one of not more than 5.0 wt. % of Mo, not more than 4.0 wt. % of Cu and not more than 1.50 wt. % of Al, at least one of not more than 0.5 wt. % of Zr, not more than 2.0 wt. % of Ti, not more than 3.0 wt. % of Nb, not more than 0.5 wt. % of V and not more than 0.5 wt. % of Ta, and at least one of not more than 0.009 wt. % of Ca and not more than 0.35 wt. % of Se.

* * * * *